US006915808B2

(12) United States Patent
McConnell et al.

(10) Patent No.: US 6,915,808 B2
(45) Date of Patent: Jul. 12, 2005

(54) VALVE DISHWASHER BASKET

(75) Inventors: Thomas E. McConnell, Santa Ynez, CA (US); Francois Hacquard, Los Angeles, CA (US); Michael E. Henley, Santa Ynez, CA (US)

(73) Assignee: Prince Lionheart, Inc., Santa Maria, CA (US)

( * ) Notice: Subject to any disclaimer, the term of this patent is extended or adjusted under 35 U.S.C. 154(b) by 316 days.

(21) Appl. No.: 10/136,520

(22) Filed: May 1, 2002

(65) Prior Publication Data

US 2003/0205259 A1 Nov. 6, 2003

(51) Int. Cl.[7] ..... B08B 3/02

(52) U.S. Cl. ..... 134/135; 134/166 R; 134/201; 211/41.8

(58) Field of Search ..... 134/135, 166 R, 134/201; 211/181.1, 89.01, 41.8, 41.9; 220/912

(56) References Cited

U.S. PATENT DOCUMENTS

| | | | | |
|---|---|---|---|---|
| 612,625 A | | 10/1898 | Decker | |
| 808,824 A | | 1/1906 | Eick | |
| 843,826 A | | 2/1907 | Kloeppinger | |
| 1,292,935 A | | 1/1919 | Walsh | |
| 1,496,957 A | | 6/1924 | Walker | |
| 1,527,326 A | | 2/1925 | Owens | |
| 1,608,283 A | | 11/1926 | Woolsey | |
| 1,618,622 A | | 2/1927 | Woolsey | |
| 1,997,849 A | * | 4/1935 | Bargar | 134/93 |
| 2,152,456 A | | 3/1939 | Barrie | |
| 2,367,448 A | | 1/1945 | Thiele | |
| 2,586,005 A | | 2/1952 | Colonna | |
| 2,741,392 A | | 4/1956 | Weiss | |
| 2,936,898 A | | 5/1960 | Miguez | |
| 3,025,864 A | * | 3/1962 | Ensign | 134/115 G |
| 3,050,073 A | | 8/1962 | McMillan | |
| 3,182,854 A | | 5/1965 | Geller | |
| 3,289,854 A | | 12/1966 | Kauffman | |
| 3,935,958 A | | 2/1976 | Frangos | |
| 3,960,290 A | | 6/1976 | Yake et al. | |
| 4,058,233 A | | 11/1977 | Frangos | |
| 4,157,145 A | | 6/1979 | Jordan | |

(Continued)

FOREIGN PATENT DOCUMENTS

| | | | |
|---|---|---|---|
| DE | P 16 42 159.3 A1 | | 8/1971 |
| DE | 29 29 227 B1 | | 10/1980 |
| DE | G 85 25 574.2 | | 12/1985 |
| DE | 296 00 642 | * | 6/1997 |
| DE | 297 01 078 | * | 7/1998 |
| FR | 2643809 | * | 9/1990 |
| FR | 2821735 | * | 9/2001 |
| JP | 11-318608 | * | 11/1999 |

OTHER PUBLICATIONS

Europena Patent Office 385,877 Sep. 1990 (Clavel et al.).*

*Primary Examiner*—Frankie L. Stinson
(74) *Attorney, Agent, or Firm*—Stetina Brunda Garred & Brucker

(57) ABSTRACT

A dishwasher basket for storing at least one valve of toddler training cups in a dishwasher for cleaning. The dishwasher basket is assembled by a top shell and a bottom shell. The top shell and bottom shell are substantially symmetrical to each other. At one part of the peripheries, the top and bottom shells are hinged with each other. At the opposing part of the peripheries, a latching means is formed, such that the dishwasher basket can be open for loading or unloading the valves, and close to securely lodging the valves therein for cleaning in the dishwasher. The dishwasher basket is attached to a top rack of the dishwasher by a basket attachment right above the water jet source, such that cleaning effect is enhanced by the pressure generated by the water jet.

19 Claims, 3 Drawing Sheets

U.S. PATENT DOCUMENTS

D254,187 S * 2/1980 Freese
4,192,432 A 3/1980 Jordan
4,193,588 A 3/1980 Doneaux
4,339,051 A 7/1982 Crawford
4,498,594 A 2/1985 Elder
4,512,489 A 4/1985 Green et al.
4,718,441 A * 1/1988 Daum et al. ..... 134/201
4,732,291 A 3/1988 McConnell
4,748,993 A 6/1988 Llewellyn
4,830,200 A 5/1989 Zambano et al.
4,836,392 A * 6/1989 Constantino ..... 211/133.5
D306,786 S * 3/1990 Ling
5,209,784 A * 5/1993 Bellman ..... 134/25.4
5,211,191 A * 5/1993 Brown ..... 134/201
D338,749 S 8/1993 McConnell
6,371,642 B1 * 4/2002 Nelson et al. ..... 383/23
6,705,333 B1 * 3/2004 Pourcho ..... 134/135

* cited by examiner

Fig. 1
(PRIOR ART)
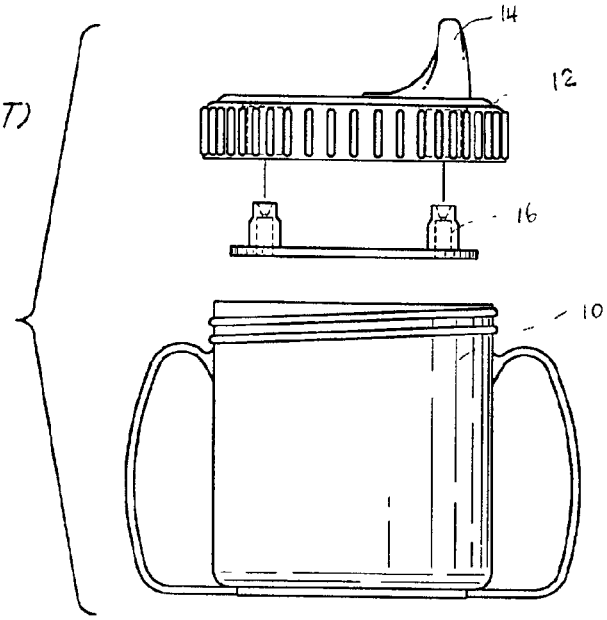
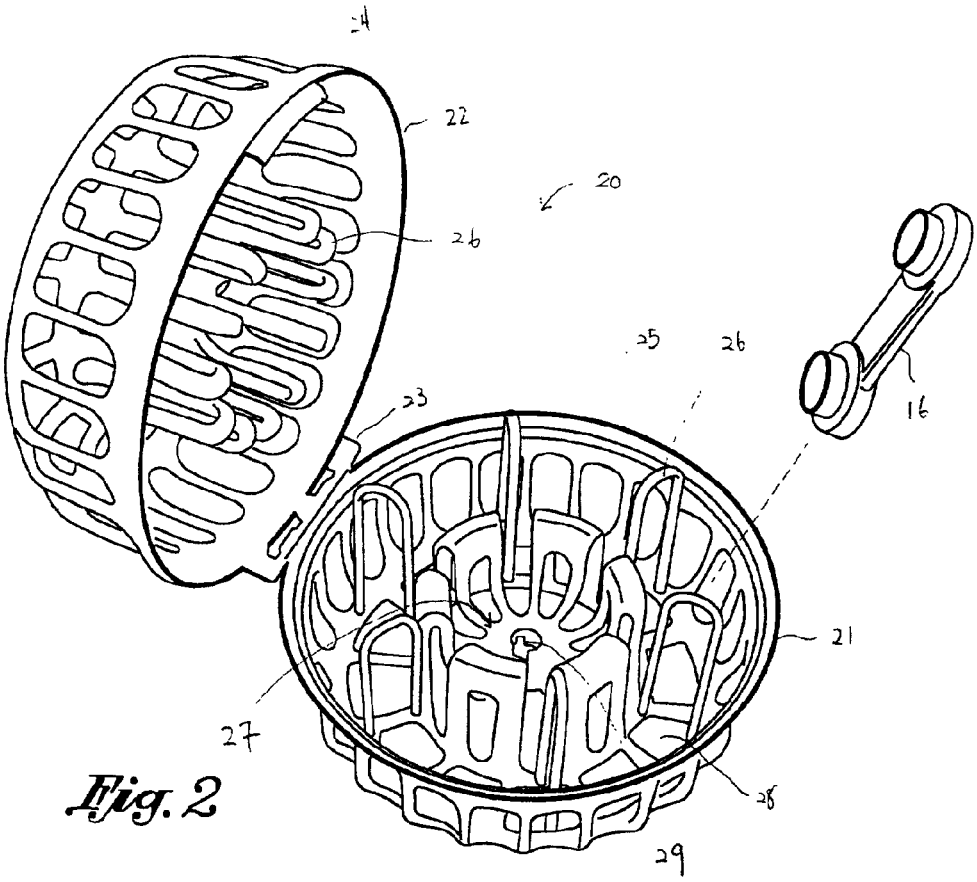
Fig. 2

VALVE DISHWASHER BASKET

CROSS REFERENCE OF RELATED APPLICATION (Not Applicable)

STATEMENT RE: FEDERALLY SPONSORED RESEARCH/DEVELOPMENT (Not Applicable)

BACKGROUND OF THE INVENTION

The present invention relates generally to a storage container, and more particularly, to a basket for storing valves of toddler training cups, suitable for use in a dishwasher.

As most children go through a stage of throwing or dropping their cups constantly, spillproof training cups are commonly used for children to learn the proper way of drinking from a cup. As shown in FIG. 1, a typical spillproof training cup, also referred as the sippy cup, comprises a hollow cup 10 to contain liquid, a lid 12 with a spout 14 allowing children to sip the liquid contained in the hollow cup 10, and a valve 16 attached underneath the lip 12 to make the training cup spillproof. The valve 16 is normally made of plastic or silicone, and is difficult to clean due to its shape and structure. Small scrub brushes can be used for hand washing the valve; however, this is very laborious. The valve can also be placed in a dishwasher for cleaning. But the conventional container or rack is inadequate to simultaneously hold the valve of a toddler training cup, while exposing it for proper cleaning in a dishwasher.

Therefore a substantial need in the art exists to provide a container that can hold the valves in a certain position in a dishwasher, while proper washing and cleaning effects is maintained.

BRIEF SUMMARY OF THE INVENTION

The present invention provides a dishwasher basket for storing at least one valve of toddler training cups in a dishwasher for proper cleaning. The dishwasher basket is preferably composed of a top shell, a bottom shell and a pair of latching means. In one embodiment, the pair of latching means include two snap type latches to releasably connect the top and the bottom shells together at two opposing parts of the peripheries thereof. Alternatively, the pair of latching means includes a hinging structure to permanently hinge one part of the peripheries of the top and the bottom shells, and a snap type latch at the opposing part of the peripheries, such that the dishwasher basket may selectively open for loading and unloading the valve, and closed for securely maintaining the valve therein thorough the dishwasher cycle. The top shell and the bottom shell are substantially symmetrical to each other and preferably formed in cylindrical or semi-spherical shape.

The dishwasher basket is preferably attached to a top rack of the dishwasher vertically above the water jet source by a basket attachment, such that complete cleaning is enhanced by the water stream pressure generated by the water jet. The basket attachment comprises an attaching means or mount for attaching to the top rack of the dishwasher, a pedestal or prong engaged with the center of the bottom shell, and an arm extending between the mount and the pedestal. Preferably, the pedestal is snapped in a center aperture of the bottom shell, and the mount comprises a clamp, a clip or a hook selectively engageable with the dishwasher rack. The arm preferably has a length no shorter than the radius of the dishwasher basket. Therefore, during washing cycle of the dishwasher, the dishwasher basket may wobble about and partially or completely axially rotate above the central axis of the pedestal to vary the attack angle of the water jet contacting the valves contained therein and further improve the washing effect of the valves.

BRIEF DESCRIPTION OF THE DRAWINGS

These, as well as other features of the present invention, will become more apparent upon reference to the drawings wherein:

FIG. 1 shows an exploded view of a prior art toddler training;

FIG. 2 illustrates a dishwasher basket for holding valves of toddler training cup according to the present invention depicted in an open configuration;

DETAILED DESCRIPTION OF THE INVENTION

Figure 3:
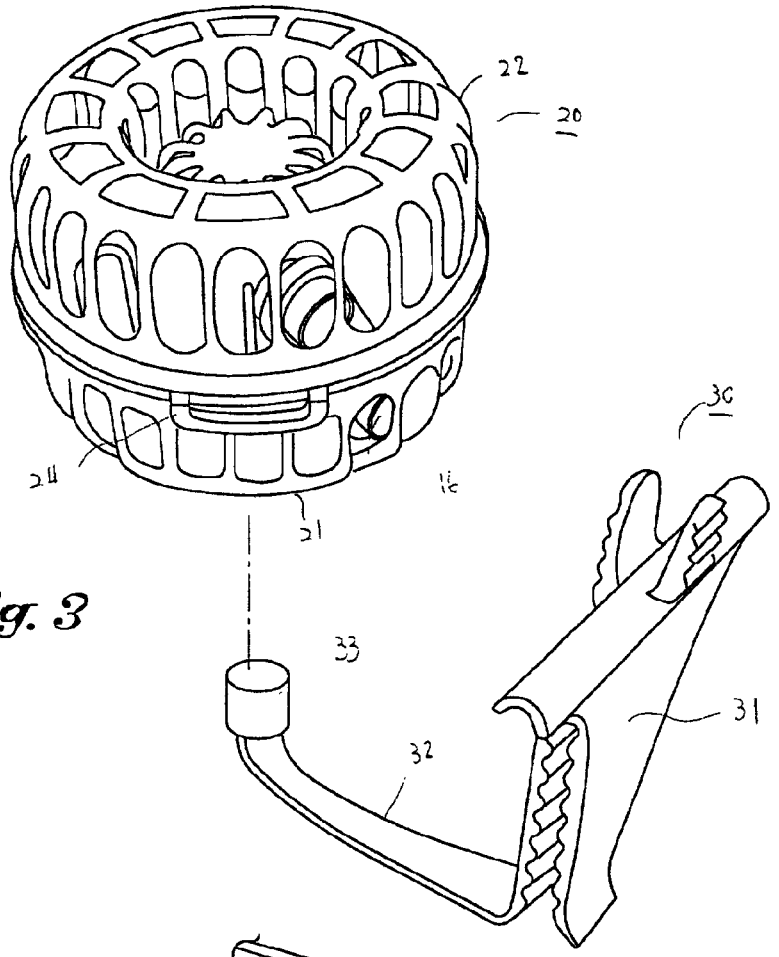
FIG. 3 is an exploded view of a dishwasher basket in a closed configuration holding a valve of toddler training cup therein and a hook for attaching the dishwasher basket to a rack of a dishwasher according to the present invention.

FIG. 2 illustrates a dishwasher basket 20 provided by the present invention. The dishwasher basket 20 includes two substantially symmetrical hollow shells 21 and 22 formed in a substantially semi-spherical or cylindrical shape. The dishwasher basket 20 is made of heat-resistant material, including heat-resistant plastic and silicone. Both of the shells 21 and 22 have a plurality of openings such that water can flow through and clean the articles stored in the dishwasher basket 20. At one part of the peripheries, the shells 21 and 22 are connected to each other, preferably, permanently hinged to each other. At an opposing part of peripheries of the shell 21 and 22, a latching means 24, preferably snap type latch, is formed allowing the basket 20 to open for loading/unloading one or more valve 16, and be closed after the valves 16 are loaded/unloaded. Alternatively, the shells 21 and 22 can also connected by a pair of latching means, such as snap type latches to allow the basket 20 to partially open, or a complete separation of the shells 21 and 22 for loading/unloading the valves 16.

The dishwasher basket 20 further comprises a plurality of dividers 25 protruding inwardly from the shells 21 and 22 to define a central area 27, and a storage area 28 of the valve 16 about the central area 27. In the storage area 28, each of the shells 21 and 22 further comprises a plurality of partition elements 26 to partition the storage area 28 into a plurality of compartments. The partitioning elements 26 comprise a plurality of wire frames protruding inwardly from the shells 21*a* and 22*a*. For example, n-shaped wire frames are formed as the partitioning elements 26 in this embodiment. Therefore, each of the valves 16 is disposed in a specific compartment without moving to the other compartment. Therefore, the adverse cleaning effect caused by crowing the valves 16 together is avoided.

Figure 4:
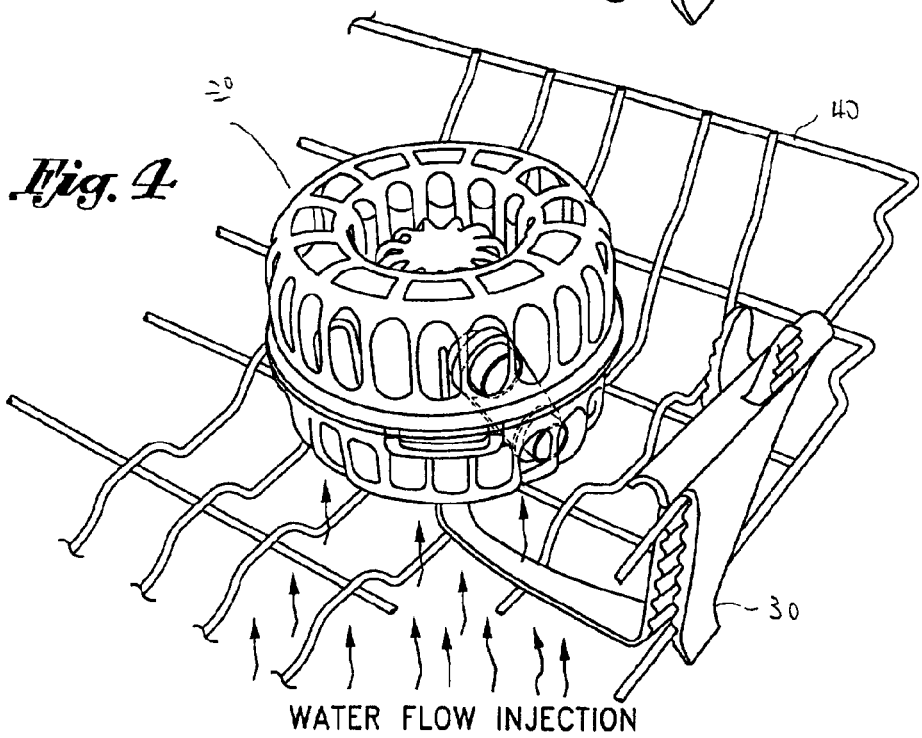
FIG. 4 shows a dishwasher basket attached to a rack of a dishwasher by means of a hook, and illustrates the water flow of the dishwasher according to the present invention.

Referring to FIG. 3, the shells 21 and 22 are indented at the central area 27. At the indented central area 27, an aperture 29 is formed at the center of at least one of the shells 21 and 22 to provide proper attachment to the rack of the dishwasher (as shown in FIG. 2). Referring to FIGS. 3 and 4, a basket attachment 30 is used to attach the dishwasher basket 20 to a rack of the dishwasher. In FIG. 3, The dishwasher basket 20 is closed and a valve 16 is stored therein. The basket attachment 30 comprises a rack mount 31, an arm 32 extending from the rack mount 31, and a pedestal 33 at the end of the arm 32. In this embodiment, the rack attachment means 31 includes a clamp, a clasp or a clip. It will be appreciated that other mount such as a hook, a snap-type latch and the like can also be used to provide the similar attaching effect. The pedestal 33 is inserted, preferably snapped into the aperture 29 to firmly engage with the dishwasher basket 20 at the central axis thereof. Preferably, the arm 32 has a length no less than the distance between the periphery to the center of the dishwasher basket 20, that is, the radius of the dishwasher basket 20.

The dishwasher basket 20 can be attached at any rack at any desired position of the dishwasher to obtain a water stream injected to the valve 16 in a specific direction. For example, the basket 20 can be horizontally aligned with the water jet to provide a water stream horizontally injected towards the valves 16. Preferably, the dishwasher basket 20 is placed in the top shelf or rack and aligned over the water jet source in a dishwasher. In FIG. 4, a valve 16 is stored in the dishwasher basket 20, and the dishwasher basket 20 is attached to the top rack 40 of the dishwasher by the basket attachment 30. During cleaning cycle, the valve 16 is washed by the water flow injection indicated by the arrows. The pressure generated by the water flow injection from various directions is thus applied to various parts of the valve to result in thorough cleaning.

Figure 5:
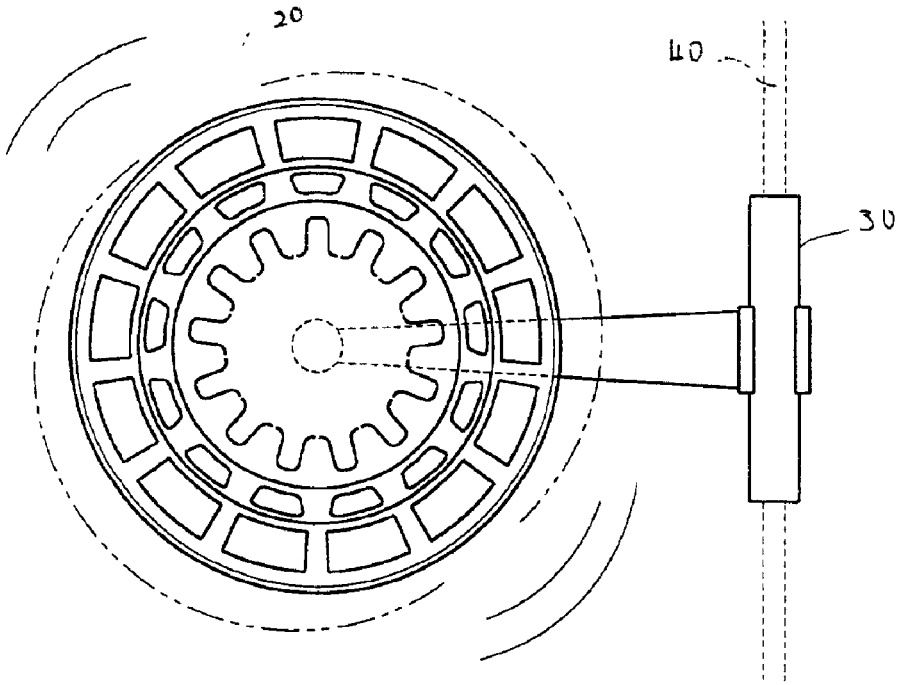
FIG. 5 shows a top view of a dishwasher basket disposed in a dishwasher during a cleaning cycle illustrating the movement of the basket relative to the water jet.
Figure 6:
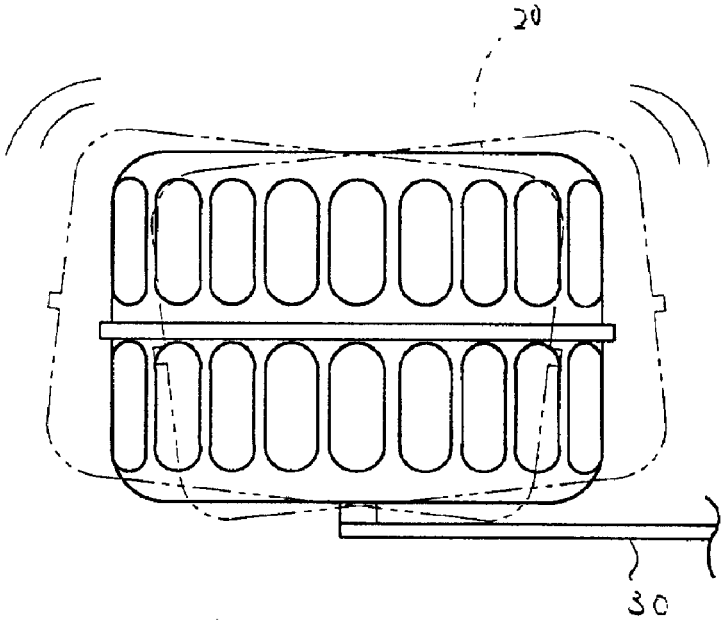
FIG. 6 shows a side view of a dishwasher basket disposed in a dishwasher during a cleaning cycle illustrating the movement of the basket.

As mentioned above, the dishwasher basket 20 is supported by the basket attachment 30 at the center 29 of the bottom shell 21 only. Therefore, the dishwasher basket 21 can wobble, bounce, shake, gyrate and partially or completely rotate about the central axis during washing cycle. The movement of the dishwasher basket 20 is shown in FIGS. 5 and 6. In FIG. 5, the horizontal movement is illustrated, while in FIG. 6, the vertical movement is shown. The movement and orientation of the valves varies the attack of angle of the water jet injection relative to the valves, such that cleaning effect is further improved.

Indeed, each of the features and embodiments described herein can be used by itself, or in combination with one or more of other features and embodiment. Thus, the invention is not limited by the illustrated embodiment but is to be defined by the following claims when read in the broadest reasonable manner to preserve the validity of the claims.

What is claimed is:

1. A dishwasher basket comprising:

a top shell, having a plurality of openings;

a bottom shell, having a plurality of openings;

a pair of latching means, at two opposing parts of the peripheries of the top shell and the bottom shell for connecting the top shell and the bottom shell; and a plurality of dividers protruding inwardly from the top and bottom shells to define a central area and a storage area about the central area.

2. The dishwasher basket according to claim 1, further comprising a plurality of partitioning elements to partition the storage area into a plurality of compartments.

3. The dishwasher basket according to claim 2, wherein the partitioning elements comprises a plurality of n-shaped wire frames such that water can flow through.

4. A dishwasher basket comprising:

a top shell, having a plurality of openings;

a bottom shell, having a plurality of openings;

a pair of latching means, at two opposing parts of the peripheries of the top shell and the bottom shell for connecting the top shell and the bottom shell;

wherein the top and bottom shells are substantially symmetrical to each other and indented at the central areas thereof.

5. A dishwasher basket, suitable for storing at least one valve of toddler training cups and use in a dishwasher for cleaning, comprising:

a top shell, having a plurality of openings such that water can flow through;

a bottom shell, having a plurality of openings such that water can flow through and an aperture at a center thereof;

a pair of latching means to connect the top shell and the bottom shell; and a basket attachment, attaching the dishwasher basket to the dishwasher from a central axis of the dishwasher basket to a rack of the dishwasher.

6. The dishwasher basket according to claim 5, wherein the basket attachment further comprising:

a pedestal, engaged with the aperture of the bottom shell;

an mount attaching to the rack; and an arm, extending between the pedestal and the mount.

7. The dishwasher basket according to claim 6, wherein the pedestal is snapped in the aperture of the bottom shell.

8. The dishwasher basket according to claim 6, wherein the mount includes a clamp.

9. The dishwasher basket according to claim 6, wherein the mount includes a clip.

10. The dishwashing basket according to claim 6, wherein the mount includes a hook.

11. The dishwasher basket according to claim 6, wherein the arm is no shorter than the distance between the center and the periphery of the bottom shell.

12. The dishwasher basket according to claim 6, wherein the arm is no shorter than the radius of the dishwasher basket.

13. The dishwasher basket according to claim 5, further comprising a divider protruding from each of the top and bottom shells to define a central area and a storage area about the central area.

14. The dishwasher basket according to claim 13, further comprising a plurality of partitioning elements protruding inwardly from each of the top and bottom shells to partition the storage area into a plurality of compartments.

15. The dishwasher basket according to claim 14, wherein the partitioning elements comprises a plurality of wire frames such that water can flow through.

16. The dishwasher basket according to claim 5, wherein the top shell and the bottom shell are substantially symmetrical to each other.

17. The dishwasher basket according to claim 5, wherein the pair of latching means include a pair of snap type latches at two opposing parts of the peripheries of the top and the bottom shells.

18. The dishwasher basket according to claim 5, wherein the pair of the latching means includes a hinging structure to permanently hinge the top shell and the bottom shell at one part of the peripheries thereof, and a latching means at an opposing of the peripheries to open the dishwasher basket for loading and unloading the valve, and to close the dishwasher basket for securely lodging the valve in the dishwasher.

19. A dishwasher basket, suitable for storing at least one valve of toddler training cups and placed in a rack of a dishwasher for cleaning, comprising:

a heat-resistant basket, having a central axis and a plurality of openings allowing waterjet of the dishwasher to flow through; and a basket attachment, engaged between a bottom part of the central axis and a part of the rack, such that the basket is aligned with the water jet in a predetermined direction, and the basket is free to move about the central axis to vary angle of attack of the water jet relative to the valve stored in the basket.

* * * * *